US009708035B1

(12) United States Patent
Czepizak et al.

(10) Patent No.: US 9,708,035 B1
(45) Date of Patent: Jul. 18, 2017

(54) VARIABLE LENGTH INFLATABLE RAMP LAUNCH AND RECOVERY SYSTEM

(71) Applicants: Kurt M Czepizak, Portsmouth, RI (US); Ryan F Galego, Barrington, RI (US); Eric H Kirchoff, Newport, RI (US); Joseph M Muhitch, Exeter, RI (US); Paul V Cavallaro, Raynham, MA (US); Andrew W Hulton, Mansfield, MA (US)

(72) Inventors: Kurt M Czepizak, Portsmouth, RI (US); Ryan F Galego, Barrington, RI (US); Eric H Kirchoff, Newport, RI (US); Joseph M Muhitch, Exeter, RI (US); Paul V Cavallaro, Raynham, MA (US); Andrew W Hulton, Mansfield, MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/272,536

(22) Filed: Sep. 22, 2016

(51) Int. Cl.

| | |
|---|---|
| ***B63B 21/56*** | (2006.01) |
| ***B63B 21/16*** | (2006.01) |
| ***B63B 21/66*** | (2006.01) |
| ***B63B 27/28*** | (2006.01) |

(52) U.S. Cl.
CPC ..... *B63B 21/56* (2013.01); *B63B 21/16* (2013.01); *B63B 21/66* (2013.01); *B63B 27/28* (2013.01); *B63B 2021/566* (2013.01)

(58) Field of Classification Search
CPC ..... B63B 21/16; B63B 21/56; B63B 21/66; B63B 27/143; B63B 27/16; B63B 27/36; B63C 9/00; B63C 9/32; B64D 25/00; B64D 25/14
USPC ..... 114/249, 253, 254, 258, 259
See application file for complete search history.

(56) References Cited

U.S. PATENT DOCUMENTS

| | | | | |
|---|---|---|---|---|
| 6,190,222 | B1 * | 2/2001 | Senger | B63C 9/32 441/82 |
| 6,536,715 | B1 * | 3/2003 | Moran | B64D 25/14 182/48 |
| 7,699,015 | B1 * | 4/2010 | Said | B63B 21/56 114/253 |
| 9,340,262 | B1 | 5/2016 | Boyd et al. | |
| 2015/0093218 | A1 * | 4/2015 | Rosche | B63B 21/66 414/138.1 |

* cited by examiner

*Primary Examiner* — Lars A Olson
(74) *Attorney, Agent, or Firm* — James M. Kasischke; Michael P. Stanley

(57) ABSTRACT

A launch and recovery system for a towed body is provided in which uninflated air beams extrude from winches where the beams enter a deployment frame and are inflated. Sealing rollers near the winches seal the air beams when the desired length of the air beams is inflated. To deploy the towed body, a positioning cart moves along the inflated air beams from an end of a deployment frame. A translating arch moves from the forward to the aft end of the positioning cart on the rails to where the tow body is released from the capture boom and swing support. The positioning cart can retract back into the deployment frame when not in use.

14 Claims, 5 Drawing Sheets

VARIABLE LENGTH INFLATABLE RAMP LAUNCH AND RECOVERY SYSTEM

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION (1) Field of the Invention

The present invention relates to launch and recovery systems, and more particularly a lightweight, containerized, inflatable launch and recovery system for towed bodies.

(2) Description of the Prior Art

Various at-sea training exercises require the launch, tracking and recovery of undersea vehicles. Due to the high costs of such vehicles; it is imperative that precautions be taken to ensure that the vehicles are not lost during exercises. Through the use of a towed body, these exercises can simulate the launch and tracking of an undersea vehicle while enabling recovery of the vehicle at the conclusion of the exercise.

Launch and recovery systems for towed bodies used in undersea warfare exercises often require installations and infrastructures that are unique to the host vessel; especially when installed aboard research vessels. The specialized handling equipment used aboard research vessels lacks the adaptability required for general use aboard multiple fleet platforms. The inability of the specialized handling equipment to readily support multiple platforms can limit fleet exercises. Furthermore, research vessels are typically unable to operate at fleet tactical speeds.

Current systems are generally vessel specific and rigid. The systems are often constructed of metal frames. These frames can take up considerable deck space that could otherwise be used for tactical operations. During at-sea exercises, the frames sometimes are subjected to overload events. As a result, the frames may permanently deform or fracture; thereby, rendering the system inoperable.

What is therefore needed is a more flexible towed body launch and recovery system design that will enable deployment from a variety of fleet platforms. The system should be capable of operation at tactical speeds. Furthermore, a system is needed that provides a structurally fail-safe mode of operation during an overload event. For example: an overload on the system should not cause major structural damage that shuts down the system.

There is also a need to minimize the deck space requirements of the launch and recovery system. In meeting these needs, the system should also reduce installation costs and infrastructure requirements.

SUMMARY OF THE INVENTION

Accordingly, it is an objective of the present invention to provide a structurally safe mode of operation for a towed body launch and recovery system.

It is a further objective of the present invention to minimize the deck space requirements of the towed body launch and recovery system.

It is a still further objective of the present invention to provide a towed body launch and recovery system that reduces installation costs and infrastructure requirements by providing a self-contained system that requires few modifications for different platforms.

In accordance with these and other objective made apparent hereinafter, an inflatable launch and recovery system with a capture and swing support for a towed body is provided to accommodate variable freeboard heights. A variable length of the ramp is achieved by changing the length of deployed air beams of the system.

In operation and during deployment, the air beams unwind off an air beam winch at varying lengths with aft ends of the air beams located in the ABDF. During the deployment, the air beams are extruded from the aft end of the ABDF where the beams are no longer restricted from expanding diametrically. Diametrically, as defined here, is the direction outward and at every point perpendicular to the circumference of the circular air beam.

The air beams are inflated from an aft end with hoses that extend a length of the beams; thereby, causing a flattened shape of the beams to inflate into a circular or rounded shape. The air hoses maintain a predetermined orientation by pressurizing the air beams within the ABDF. Rollers near the air beam winches seal the air beams; thereby, allowing the beams to inflate to a design pressure and then become rigid. As the air beams inflate and contact the ABDF; this inflation outwardly extrudes the beams. Once the desired length of the air beams is inflated; the length is fixed by locking the rollers to prevent a further extension of the air beams.

To deploy a tow body into the liquid medium, a positioning cart transitions from the ABDF to the aft end of the deployed and inflated air beams. By using inflated air beams with constant diameters; the positioning cart with vertical wheel spacing securely engages the extended air beams and can then deploy a tow body.

The invention simplifies the transition between the ABDF and the air beams because a large step down to a different diameter is not needed. Also, the positioning cart can travel the length of the ABDF and the inflatable air beams for deployment and when not in use, for retraction.

The positioning cart is the primary interface with the tow body by hosting a capture and swing support for tow body capture and release. A translating arch that rides rails of the positioning cart moves from the forward to the aft end of the positioning cart where the tow body can be released from the capture boom and swing support.

To further the modularity of the inventive system, the interchangeable tow body hardware allows for various top tow and nose tow bodies to be used. The cart and deployment operations remain the same, with only the interface hardware being interchangeable for different mission packages.

Other objects, features and advantages of the present invention including various novel details of construction and combinations of parts, will now be more particularly described with reference to the accompanying drawings and pointed out in the claims. It will be understood that the particular assembly embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent, wherein corresponding reference characters indicate corresponding parts throughout the several views of the drawings and wherein.

DETAILED DESCRIPTION OF THE INVENTION

Figure 1:
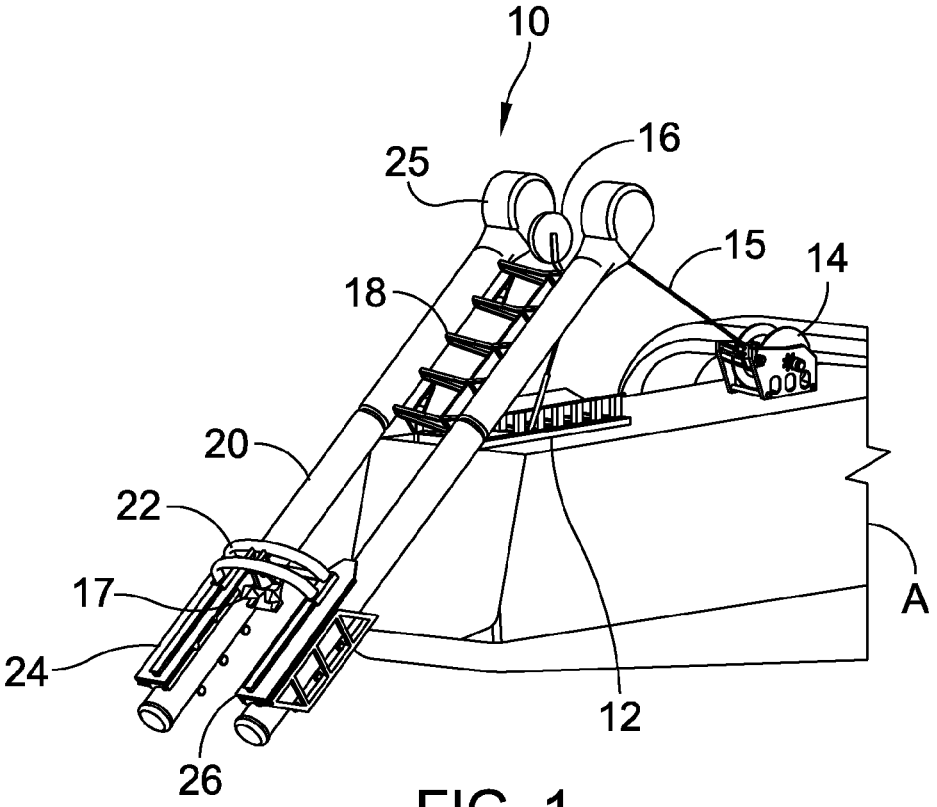
FIG. 1 depicts a launch and recovery system of the present invention in which a variable length inflatable ramp launch and recovery system is in an extended position.

Referring now to FIG. 1, there is shown an inflatable launch and recovery system 10 mounted on a vessel A (only partially shown in the figure) with the system shown in an extended position. Typically, the inflatable launch and recovery system 10 is mounted at an aft end of the vessel A, such that the system can trail behind the vessel when deployed. In the stowed position, the inflatable launch and recovery system 10 is mostly deflated.

In the figure, the launch and recovery system 10 is mechanically connected to a mounting frame 12 and is movable to a tilted position by use of a tow cable winch 14 and pistons (not shown). The tow cable winch 14 allows the system 10 to hinge off the mounting frame 12.

A tow cable 15 passes from the tow cable winch 14 around a pulley 16 and attaches to a capture boom and swing support 17. The launch and recovery system 10 extends from the mounting frame 12 such that an air beam deployment frame (ABDF) 18, duel air beams 20, a translating arch 22 and a positioning cart 24 move to a direction for deployment or release of a tow body 100 (not shown). Indirectly, the tow cable 15 also affects the translating arch 22 and the positioning cart 24. See FIG. 10 for placement of the tow body 100.

The air beams 20 are braided, fabric structures that can be pressurized to provide axial, bending, shear and torsional stiffness. In operation, each air beam 20 unwinds from an air beam winch 25 and when inflated extrudes out of the ABDF 18. The ABDF 18 is a rigid and hollow support structure that houses the deflated air beams 20; serves as an attachment structure for the air beams and tilts as a guide for deployment or retrieval of the air beams. The air beam winch 25 winds the tow cable 15 and secures the deflated air beams 20.

The positioning cart 24 is a rigid structure that sits atop the ABDF 18 and travels to the end of the extended air beams 20 for deployment. The positioning cart 24 supports the translating arch 22 and has rails 26 for the arch to slide across when the system 10 is in the tilted position. The translating arch 22 slides across the positioning cart 24 to the deploying position.

The mounting frame 12 is a structure that attaches to the ABDF 18 and to sockets on the deck of the vessel A. The mounting frame 12 includes an aft hinge for tilting the ABDF 18 and a piston (not shown) to hold the ABDF at different tilt angles. The tow cable winch 14 transitions the positioning cart 24 along the ABDF 18 and the air beams 20. The tow cable winch 14 also extends the tow cable 15 into the water to tow a tow body 100 during deployment and retraction during retrieval of the tow body.

Figure 2:
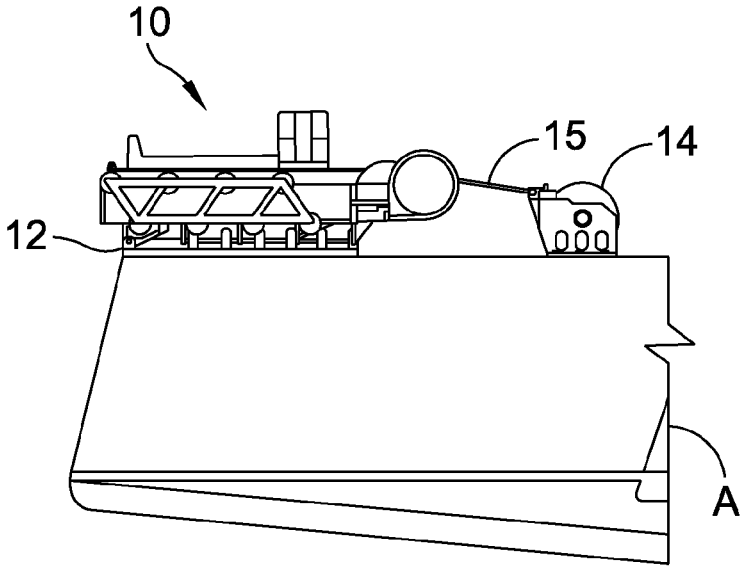
FIG. 2 depicts the inflatable ramp launch and recovery system in a stowed position.
Figure 3:
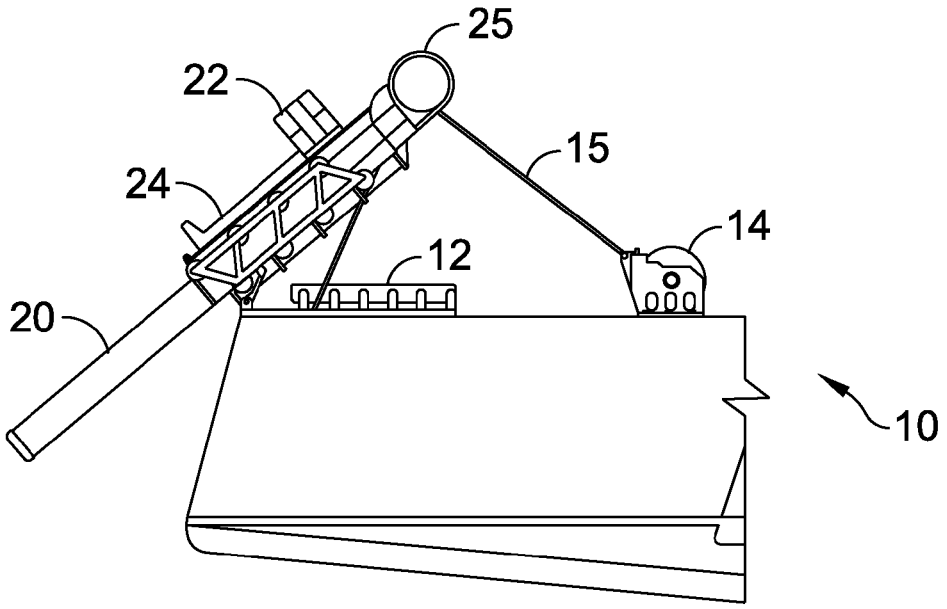
FIG. 3 depicts the inflatable ramp launch and recovery system at a tilt.

In FIG. 2, the variable length inflatable ramp launch and recovery system 10 is shown in a stowed position. In the figure, the system 10 is secured on the mounting frame 12 by the tow cable winch 14 and is also secured by being in a position at rest on the frame. In FIG. 3, the launch and recovery system 10 is shown at a tilt with the translating arch 22 and the cart 24 positioned proximate to the air beam winch 25 with the air beams 20 partially deployed.

Figure 4:
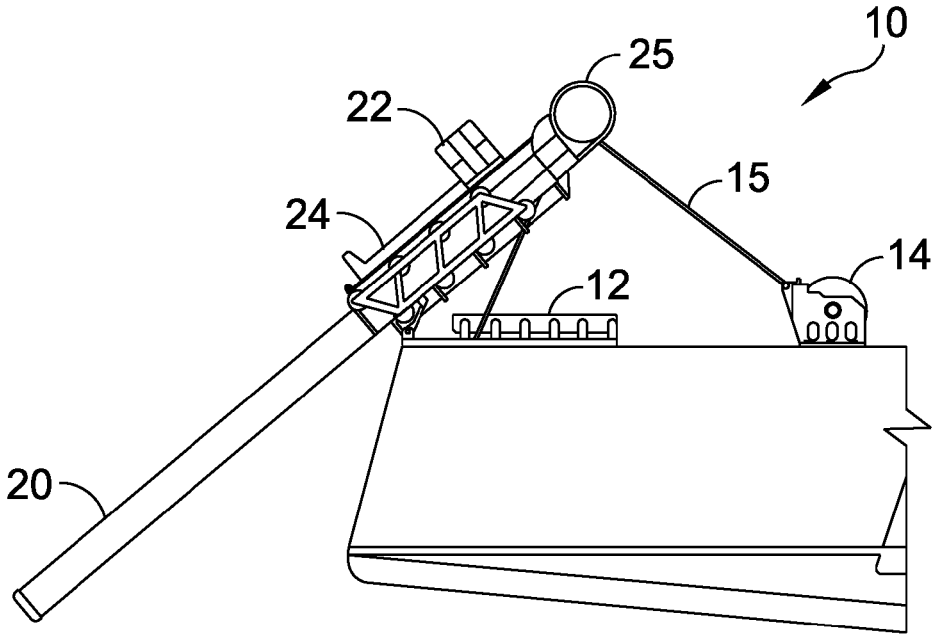
FIG. 4 depicts the inflatable ramp launch and recovery system at a tilt with the scope of extension exceeding that of FIG. 3.

In FIG. 4, the launch and recovery system 10 in a tilted position is shown with the translating arch 22 and the positioning cart 24 positioned proximate to the air beam winch 25 with the air beams 20 fully deployed. The system 10 is held in position by the tow cable winch 14 and the tow cable 15.

Figure 5:
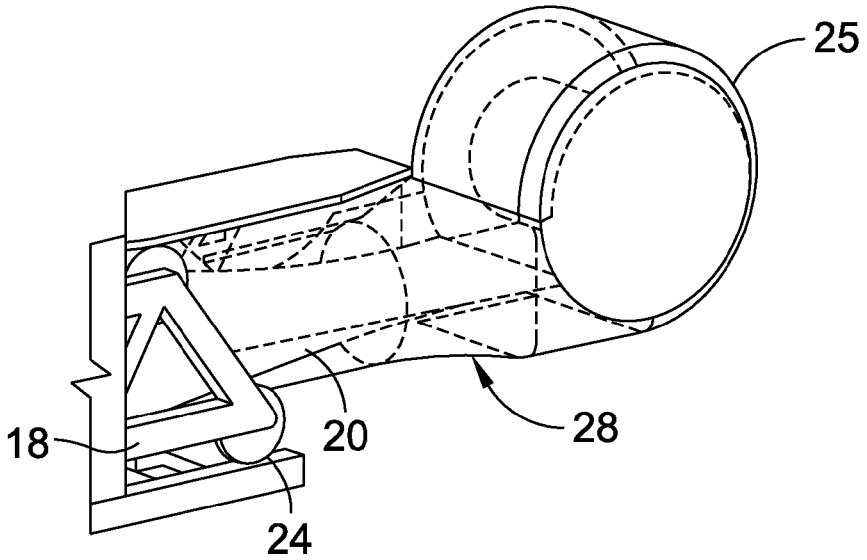
FIG. 5 depicts the launch and recovery system in which there is an air beam transition from a flattened shape inside a drum to a cylindrical shape inside an air beam deployment frame (ABDF) with parts of the figure shown as transparent to ease identification of the location of certain components.
Figure 6:
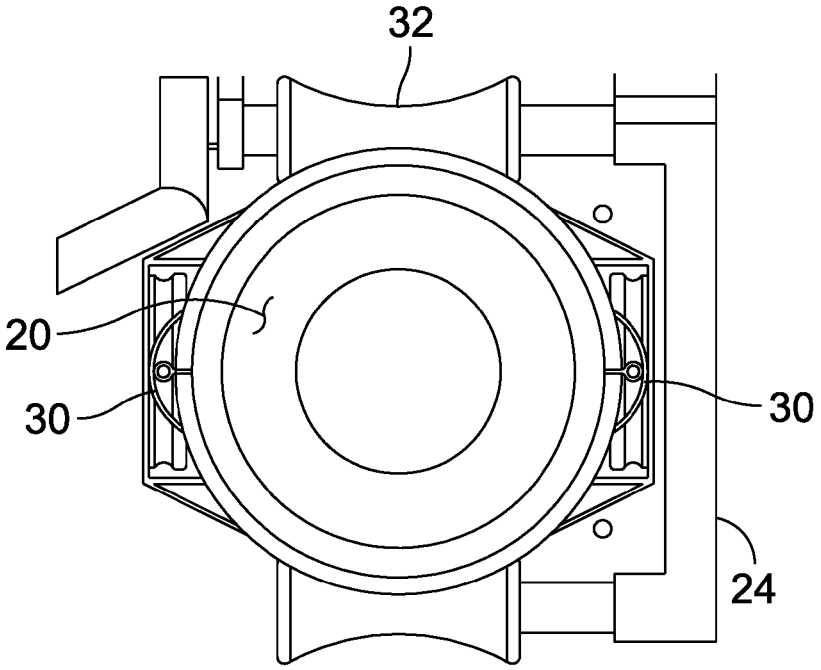
FIG. 6 depicts the launch and recovery system in which air hoses are used to fill and orient the air beam.

In FIG. 5, the air beam winch 25 is shown extending the air beam 20 thru a transition area 28 where an uninflated air beam is inflated. In FIG. 6, the air beam 20 extends thru the ABDF 18 and is positioned on the cart 24 where air hoses 30 inflate the air beam as cart wheels 32 contain the inflation. The cart wheels 32 attach to the cart 24 at the inflatable air beams 20 and the ABDF 18. Due to the minimal diametric difference between the ABDF 18 and the air beams 20, no step down is necessary.

Figure 7:
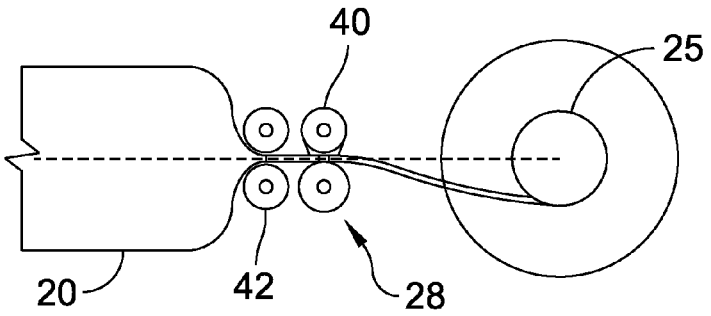
FIG. 7 depicts the launch and recovery system with sealing and drive rollers for the air beam.

In FIG. 7, the inflation of an air beam 20 is shown. In the figure, the air beam 20 is unrolled from the air beam winch 25. Prior to inflation, the transition area 28 restricts the inflation until the air beam 20 can be inflated by the air hoses 30. The air hoses 30 are embedded on the side of the air beams 20 such that both the hoses and the air beam coil and deploy together while the air hoses inflate the air beam (See FIG. 10 for the air hoses positioned on a deployed air beam).

The transition area 28 includes sealing rollers 40 and drive rollers 42. The sealing rollers 40 and drive rollers 42 are activated through the use of motors and controllers (not shown) with the sealing and drive rollers operating independently. The sealing rollers 40 only translate in and out to seal the air beams 20 and can spin freely. The drive rollers 42 translate in and out to engage the air beams 20 and additionally have a driven rotation to force extrusion.

The drive rollers 42 extrude the air beams 20 from the air beam winch 25 and the sealing rollers 40 seal the air beams during inflation. The air beams 20 enter a forward end of the ABDF 18 and extend out an aft end of the ABDF during deployment. The air hoses 30 run the length of the air beams 20 and can inflate from the aft end of the air beams. The air hoses 30 also orient the air beams 20 inside the ABDF 18. The air for the air hoses 30 is supplied from an onboard tank which is replenished by an air compressor.

Figure 8:
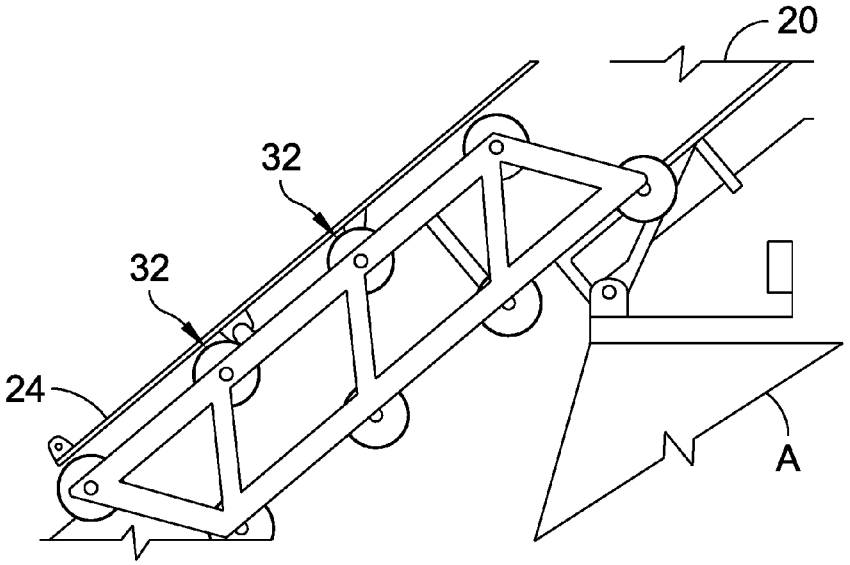
FIG. 8 depicts the launch and recovery system with a side view of the positioning cart transition from the ABDF to the inflatable air beams with parts of the figure shown as transparent to ease identification of the location of certain components.
Figure 9:
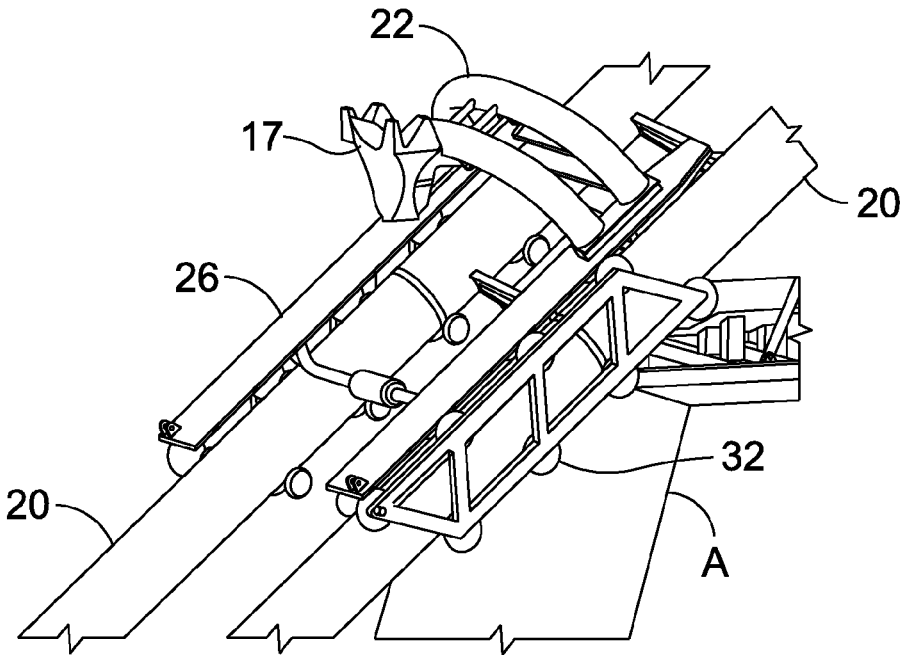
FIG. 9 depicts the launch and recovery system with an isometric view of transition from the ABDF to the inflatable air beams with parts of the figure shown as transparent to ease identification of the location of certain components.
Figure 10:
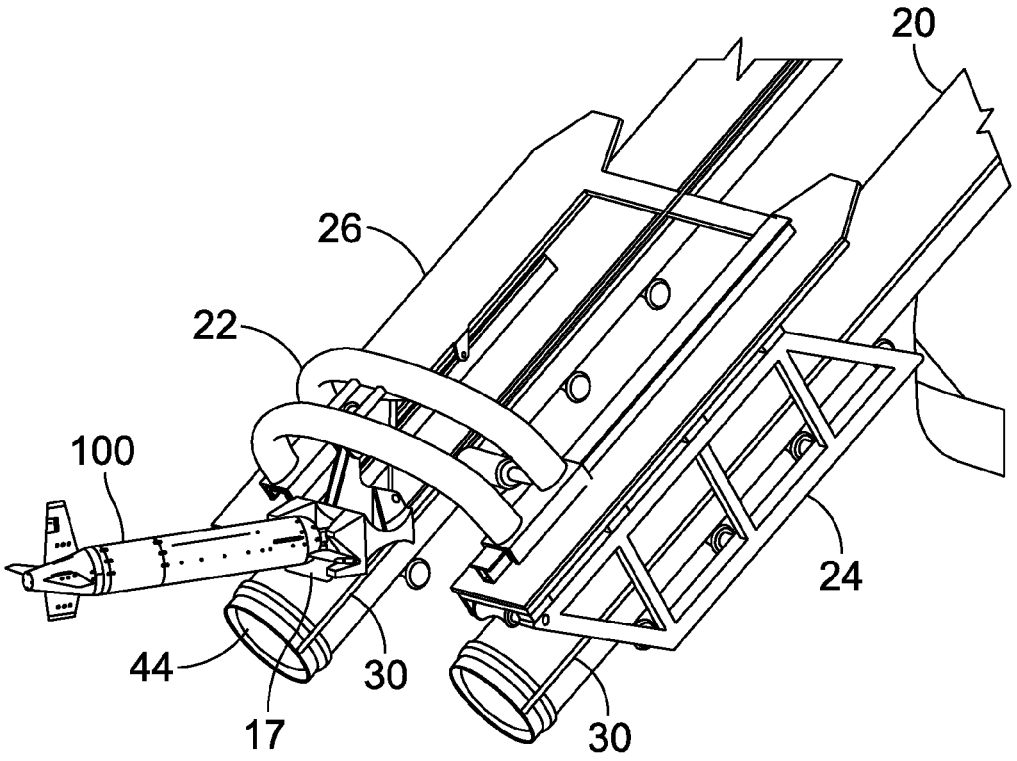
FIG. 10 depicts the launch and recovery system in the deployed position.

In FIG. 8, a side view of the positioning cart 24 is shown with the inflatable air beam 20 encased. The positioning cart 24 includes the cart wheels 32 sized to roll on the extended and inflated air beams 20. As shown in FIG. 9 and FIG. 10, the positioning cart 24 includes the translating arch 22 and a capture boom and swing support 17 which can hold the tow body 100.

The capture boom and swing support 17 is a tow body interface underneath the translating arch 22 that is used to capture and release the tow body 100. The capture boom and swing support 17 can also provide support to the tow body 100. The tow body 100 is deployed and towed in the water behind the vessel A. The tow body 100 can have either a nose or top towing fixture.

In operation, the air beams 20 unwind off the air beam winch 25 at varying lengths. The uninflated air beams 20 deploy from the air beam winch 25 where the beams enter the air beam deployment frame (ABDF) 18 and are no longer restricted from expanding diametrically.

The air beams 20 are inflated from an aft end with the air hoses 30 that extend a length of the beams to a ring-secured and hardened end cap 44; thereby, causing a flattened shape of the beams to inflate into a rounded shape. The air hoses 30 maintain a predetermined orientation of the air beams 20 inside the ABDF 18. The sealing rollers 40 near the air beam winches 25 seal the air beams 20; thereby, allowing the beams to inflate to a design pressure and become rigid. As the air beams 20 inflate and contact the ABDF 18; this inflation outwardly extrudes the beams.

Once the desired length of the air beams 20 is inflated; the length is fixed by locking the sealing rollers 40 to prevent further extrusion. Through this inflation; variable freeboard heights are accommodated to allow for installation of the system onto different host ships.

To deploy the tow body 100 into a liquid medium, the positioning cart 24 transitions from the ABDF 18 to the aft end of the variable length inflatable ramp launch and recovery system 10. By using inflatable air beams with constant diameters; the positioning cart 24 with fixed vertical wheel spacing is able to deploy the tow body 100. The invention simplifies the transition between the ABDF 18 and the air beams 20 because a large step down does not need to be overcome. The positioning cart 24 can scale the length of both the ABDF 18 and the inflatable air beams 20 for deployment and retract back into the ABDF when not in use. The positioning cart 24 is the primary interface with the tow body by hosting the capture boom and swing support 17 for capture and release. The translating arch 22 moves from the forward to the aft end of the positioning cart 24 on the rails 26 to where the tow body 100 is released from the capture boom and swing support 17.

The air beams 20 can be fabricated of continuously circular braided material, reinforced with tensile webbing straps for shaping. As is known to those of skill in the art, tubes fabricated in this manner maintain their shapes when inflated.

For enhanced damage tolerance and puncture resistance; the skins of the drop stitch and tube fabrics would use dense woven architectures. For even greater damage tolerance and improved drop yarn strength; the use of crimp-imbalanced woven architectures are recommended in accordance with U.S. Pat. No. 8,555,472 and the progeny of this referenced patent. The air beams 20 can be protected from environmental exposure through the use of a laminated elastomeric coating.

As a further example, the inflatable air beams 20 can be constructed solely of spacer fabrics, cylindrical arches, cylindrical beams, or any mixture thereof using any flexible material that can maintain a shape when inflated and subjected to anticipated loads.

To further the modularity of the inventive system, the interchangeable tow body hardware allows for various top tow and nose tow bodies to be used. The cart and deployment operations remain the same, with only the interface hardware needing replacement for different mission packages.

The foregoing description of the preferred embodiments of the invention has been presented for purposes of illustration and description only. It is not intended to be exhaustive or to limit the invention to the precise form disclosed; and obviously many modifications and variations are possible in light of the above teaching.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A variable length inflatable ramp launch and recovery system for a towed body, said launch and recovery system comprising:

a tow cable winch securable to a vessel;

a tow cable partially wound on said tow cable winch and connectable to the towed body;

a mounting frame with a flattened plane securable to the vessel aft of said tow cable winch when said winch is secured, with said mounting frame including an angled longitudinal cradle as a second plane opposite and facing away from said flattened plane, both planes separated at a distance by a support structure;

an air beam deployment frame with a first end hinged at said mounting frame, said deployment frame having an angled longitudinal protrusion sized to rest in said angled cradle;

a pair of air beam winches secured on a side of said angled protrusion opposite a side facing said angled cradle and at a second end of said deployment frame;

a pulley attached to said air beam deployment frame between said air beam winches with said pulley sized to control direction of said tow cable;

a pair of inflatable air beams, each of said air beams partially wound at a deflated section around each of said air beam winches;

a positioning cart having two flat sections spaced apart with each flat section parallel to each air beam and with each said flat section having a first and second plane with said first plane facing away from said mounting frame and having a rail protruding from a longitudinal axis of said first plane, with each said flat section having brackets extending perpendicular in direction from said second plane at longitudinal edges of said flat sections such that said brackets of each flat section encompass each of said air beams, each of said brackets including at least four cart wheels sized to roll on a curvature of each of said extended and inflated air beams;

a translating arch with ends resting on each said rail with a curvature of said arch spaced away from said cart wherein said translating arch is capable sliding along said rails of said positioning carts to a deploying position; and a capture boom and swing support affixed to an underside of the curvature of said translating arch wherein said capture boom and swing support is capable of holding the tow body;

wherein each said air beam is capable of unwinding from each said air beam winch when each said air beam is inflated to extrude into said air beam deployment frame and wherein each said air beam winch is capable of winding each said air beam to stow each said air beam when deflated;

wherein said tow cable is wound on said tow cable winch when said extendable beams are deflated, said tow cable unwound and when said extendable beams are inflated;

wherein said positioning cart is capable of moving to an end of said extended air beams away from said air beam winches and using said capture boom and swing support for deployment of the towed body by releasing said tow cable from the towed body.

2. The launch and recovery system in accordance with claim 1, said system further including two pairs of at least two sealing rollers with each of said pairs of sealing rollers positioned between said cart and each of said air beam winches wherein each of said sealing rollers when mated with another of said sealing rollers is capable of sealing each of said air beams during inflation.

3. The launch and recovery system in accordance with claim 2, said system further including two pairs of at least two drive rollers with each of said drive rollers positioned between said sealing rollers and said cart wherein each of said drive rollers when mated with another of said drive rollers is capable of extruding each of said air beams from each of air beam winches.

4. The launch and recovery system for a towed body in accordance with claim 3, wherein said air beams are braided fabric structures.

5. A method for deployment of a towed body from a vessel, said method comprising the steps of:

providing a deployment and recovery system with two air beam winches, two air beams partially wound on the air beam winches, an air beam deployment frame, a positioning cart encompassing and movable on the air beams, a translating arch spanning the positioning cart and a capture boom and swing support attached to an underside of the translating arch;

tilting the air beam deployment frame aft and away from a mounting frame secured to the vessel;

extruding each air beam from each of the air beam winches;

inflating each air beam into a first end of the air beam deployment frame proximate to one of the air beam winches;

extending each air beam from another end of the air beam deployment frame;

sealing an end of each of the air beams subsequent to said inflating step;

extending a cable from a tow cable winch with one end of the cable attached to the winch and another end attached to the towed body;

moving the translating arch and positioning cart aft and to an end of the extended air beams; and deploying the towed body by releasing the towed body from the capture boom and swing support when the tow cable is released from the towed body.

6. The method of claim 5, said method further comprising the step of tilting the deployment and recovery system such that the air beam deployment frame tilts away from the mounting frame at varying angles.

7. The method of claim 6, said method comprising the further step of inflating the air beams with connectable air hoses.

8. The method of claim 7, wherein said extruding step is accomplished by a rolling motion of mating drive rollers.

9. The method of claim 8, wherein said sealing step is accomplished by a translational crushing motion of mating sealing rollers.

10. A method for retrieval of a towed body from a vessel, said method comprising the steps of:

providing a deployment and recovery system with two air beam winches, two air beams partially wound on the air beam winches, an air beam deployment frame, a positioning cart encompassing and movable on the air beams, a translating arch spanning the positioning cart and a capture boom and swing support attached to an underside of the translating arch;

tilting the air beam deployment frame aft and away from a mounting frame secured to the vessel;

extruding each air beam from each of the air beam winches into a first end of the air beam deployment frame proximate to the air beam winches;

inflating the air beams into the air beam deployment frame and out of second end of the air beam deployment frame;

sealing an end of each of the air beams subsequent to said inflating step;

extending a cable from a tow cable winch with one end of the cable attached to the winch and another attached to the capture boom and swing support;

moving the translating arch and positioning cart aft and to an end of the extended air beams; and retrieving the towed body by securing the towed body with the capture boom and swing support when the tow cable is attachable to the towed body.

11. The method of claim 10, said method further comprising the step of tilting the deployment and recovery system such that the air beam deployment frame tilts away from the mounting frame at varying angles.

12. The method of claim 11, said method comprising the further step of inflating the air beams with connectable air hoses.

13. The method of claim 12, wherein said extruding step is accomplished by a rolling motion of mating drive rollers.

14. The method of claim 13, wherein said sealing step is accomplished by a rolling motion of mating sealing rollers.

* * * * *